US009352948B2

(12) United States Patent
Orita

(10) Patent No.: US 9,352,948 B2
(45) Date of Patent: May 31, 2016

(54) WATER DISPENSER

(71) Applicant: Kabushiki Kaisha Cosmo Life, Hyogo (JP)

(72) Inventor: Yoshinori Orita, Kyogo (JP)

(73) Assignee: KABUSHIKI KAISHA COSMO LIFE, Hyogo (JP)

( * ) Notice: Subject to any disclaimer, the term of this patent is extended or adjusted under 35 U.S.C. 154(b) by 0 days.

(21) Appl. No.: 14/388,831

(22) PCT Filed: Mar. 26, 2013

(86) PCT No.: PCT/JP2013/058734

§ 371 (c)(1),
(2) Date: Sep. 29, 2014

(87) PCT Pub. No.: WO2013/150918

PCT Pub. Date: Oct. 10, 2013

(65) Prior Publication Data

US 2015/0060492 A1 Mar. 5, 2015

(30) Foreign Application Priority Data

Apr. 2, 2012 (JP) ..... 2012-083785

(51) Int. Cl.
*B67D 1/08* (2006.01)
*B67D 1/00* (2006.01)
*B67D 3/00* (2006.01)

(52) U.S. Cl.
CPC ..... *B67D 1/0009* (2013.01); *B67D 1/0857* (2013.01); *B67D 3/0009* (2013.01); *B67D 3/0035* (2013.01); *B67D 3/0038* (2013.01); *B67D 1/0895* (2013.01); *B67D 3/0022* (2013.01)

(58) Field of Classification Search
CPC ..... B67D 3/0032; B67D 7/24; B67D 1/0009; B67D 1/0857; B67D 3/0009; B67D 3/0035; B67D 3/0038
USPC ..... 222/146.1, 80–87, 146.6; 141/18, 330; 215/250
See application file for complete search history.

(56) References Cited

U.S. PATENT DOCUMENTS 4,699,188 A * 10/1987 Baker ..... B67D 3/00 141/18
4,881,380 A * 11/1989 Mrugala et al. ..... 62/389
(Continued)

FOREIGN PATENT DOCUMENTS

JP 2001-153523 6/2001
JP 2010-235135 10/2010
(Continued)

OTHER PUBLICATIONS

International Search Report issued Apr. 23, 2013 in International (PCT) Application No. PCT/JP2013/058734.
(Continued)

*Primary Examiner* — Kevin P Shaver
*Assistant Examiner* — Robert Nichols, II
(74) *Attorney, Agent, or Firm* — Wenderoth, Lind & Ponack, L.L.P.

(57) ABSTRACT

A water dispenser is provided which is capable of smoothly drawing up drinking water in a raw water container with a pump until drinking water in the raw water container is used up. The water dispenser includes a cold water tank (2) and a hot water tank (3), a container holder (5) in which a replaceable raw water container (4) can be placed, and an insertion pipe (6) adapted to be inserted through a water outlet (10) of the raw water container (4). A water receiving container (7) is mounted to a lower portion (13) of the container holder (5) and is adapted to receive drinking water. The water receiving container (7) is in communication with the cold water tank (2) through a raw water supply line (8) to which a pump (9) is mounted. The insertion pipe (6) has its bottom end disposed in the water receiving container (7).

1 Claim, 3 Drawing Sheets

(56) References Cited

U.S. PATENT DOCUMENTS

| | | | | |
|---|---|---|---|---|
| 4,958,747 | A * | 9/1990 | Sheets | 222/67 |
| 6,101,835 | A * | 8/2000 | Butsch et al. | 62/390 |
| 8,056,358 | B1 | 11/2011 | Shelton | |
| 8,306,723 | B2 * | 11/2012 | Haskara et al. | 701/114 |
| 8,356,731 | B2 * | 1/2013 | Xiao et al. | 222/67 |
| 2009/0014366 | A1 | 1/2009 | Takeda et al. | |
| 2010/0116847 | A1 * | 5/2010 | Foroughi et al. | 222/81 |
| 2011/0056981 | A1 | 3/2011 | Xiao et al. | |

FOREIGN PATENT DOCUMENTS

| | | |
|---|---|---|
| JP | 2011-148532 | 8/2011 |
| JP | 2011-207521 | 10/2011 |
| WO | 2007/094364 | 8/2007 |

OTHER PUBLICATIONS

Extended European Search Report issued Mar. 17, 2016 in corresponding European Application No. 13772493.6.

* cited by examiner

WATER DISPENSER

TECHNICAL FIELD

This invention relates to a water dispenser capable of feeding drinking water in a replaceable raw water container, such as mineral water.

BACKGROUND ART

Conventional water dispensers were used mainly in offices and hospitals. However, with the growing interest in safety of water and in health, the number of water dispensers used in private homes is increasing these days.

A typical known home-use water dispenser includes a cold water tank in which drinking water is stored and cooled, and a replaceable raw water container disposed at a level lower than the cold water tank. The raw water container is in communication with the cold water tank through a raw water supply line in which a pump is mounted (see e.g. JP Patent Publication 2001-153523A).

Drinking water cooled in the cold water tank of this water dispenser can be discharged e.g. into a cup. When the water level in the cold water tank falls to a predetermined value, the pump is activated to feed drinking water in the raw water container into the cold water tank through the raw water supply line.

If the raw water container is rigid enough that the raw water container is not collapsible when water remaining in the raw water container decreases, when drinking water remaining in the raw water container becomes scarce, and a negative pressure tends to be created in the raw water container, which interferes with the supply of drinking water from the raw water container to the cold water tank. This may make it impossible to use up the drinking water in the raw water container.

SUMMARY OF THE INVENTION

An object of the present invention is to provide a water dispenser capable of smoothly lifting drinking water in the raw water container by means of a pump, until drinking water in the raw water container is used up.

In order to achieve this object, the present invention provides a water dispenser comprising a cold water tank in which drinking water can be cooled, a container holder located at a level lower than the cold water tank and configured such that a replaceable raw water container can be placed in the container holder with a water outlet of the raw water container facing downward, an insertion pipe mounted to the container holder and configured to be inserted through the water outlet when the raw water container is placed in the container holder, a water receiving container configured to receive drinking water flowing from the raw water container through the water outlet and the insertion pipe, a vent hole through which air can be introduced into and discharged from the water receiving container, and a raw water supply line through which drinking water in the water receiving container can be drawn up into the cold water tank by a pump, wherein the insertion pipe has a bottom end disposed in the water receiving container.

With this arrangement, when the raw water container is placed in the container holder, since the insertion pipe is inserted through the water outlet of the raw water container, air in the water receiving container flows into the raw water container through the insertion pipe, while drinking water in the raw water container flows out into the water receiving container through the insertion pipe.

This results in the rise of the water level in the water receiving container. When the water surface reaches the bottom end of the insertion pipe, air in the water receiving container stops flowing into the raw water container, which stops the flow of drinking water from the raw water container.

On the other hand, when drinking water in the water receiving container is fed into the cold water tank through the raw water supply line by the pump, and as a result, the water level in the water receiving container falls until the water surface separates from the bottom end of the insertion pipe, air in the water receiving container begins to again flow into the raw water container through the insertion pipe, thus allowing drinking water in the raw water container to flow out into the water receiving container through the insertion pipe.

In the water dispenser according to the present invention, when drinking water in the raw water container flows out into the water receiving container, which is disposed under the raw water container, air in the water receiving container flows into the raw water container through the insertion pipe, thus preventing negative pressure from being created in the raw water container. This in turn makes it possible to smoothly draw up drinking water in the water receiving container until drinking water in the raw water container is used up.

DETAILED DESCRIPTION OF THE INVENTION

Figure 1:
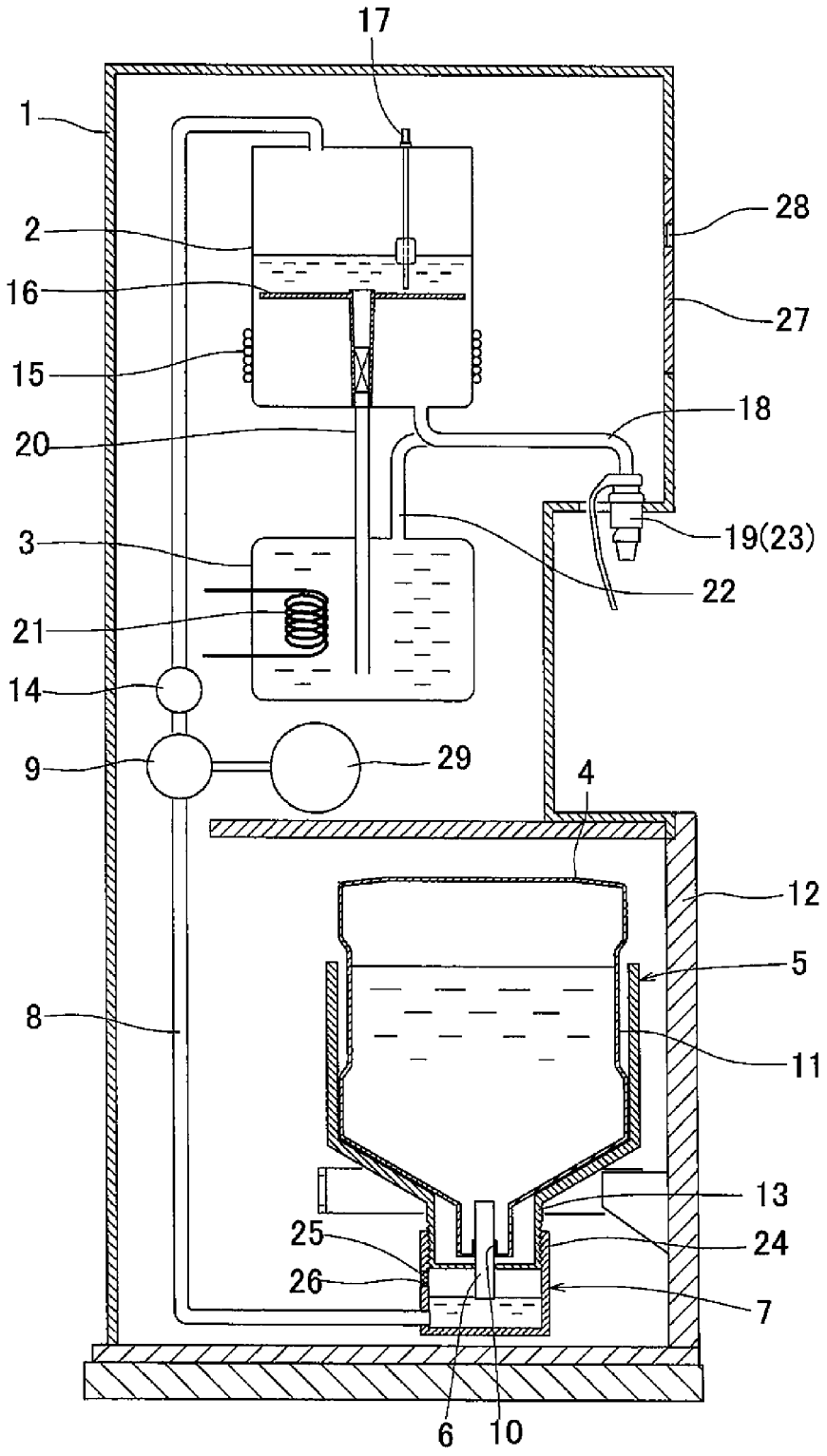
FIG. 1 is a sectional view of a water dispenser embodying the present invention, as viewed from one side of the water dispenser.

The water dispenser embodying the present invention is now described with reference to FIGS. 1 to 3.

The water dispenser includes a casing 1, a cold water tank 2 and a hot water tank 3 that are mounted in the casing 1, and a container holder 5 located below the cold water tank 2 and capable of receiving a replaceable raw water container 4. An insertion pipe 6 is mounted to the container holder 5 and configured to be inserted through a water outlet 10 of the raw water container 4 when the raw water container 4 is received in the container holder 5. The water dispenser further includes a water receiving container 7 configured to receive drinking water flowing out of the raw water container 4 through the water outlet 10 and the insertion pipe 6, and a raw water supply line 8 through which drinking water in the water receiving container 7 can be lifted into the cold water tank 2 by a pump 9.

The cold water tank 2 is mounted at an upper level in the casing 1, while the hot water tank 3 is provided under the cold water tank 2. The water dispenser further includes a slide table 12 provided at a lower level of the casing 1 and below the hot water tank 3 so as to be slidable in a horizontal direction relative to the casing 1. The container holder 5 is mounted on the slide table 2. Thus, the cold water tank 2 and the hot water tank 3 are arranged in the vertical direction with the cold water tank 2 over the hot water tank 3, while the container holder 5 is provided below the hot water tank 3. A display panel 27 is mounted to the upper front side of the casing 1.

The display panel 27 carries a container replacement lamp 28 configured to indicate the necessity to replace the raw water container 4 with a new one.

The raw water container 4 is placed in the container holder 5 with the water outlet 10 facing down. The raw water container 4 has a trunk portion 11 which is sufficiently rigid such that the raw water container 4 is not collapsible when water remaining in the raw water container 4 decreases. Such a rigid raw water container 4 can be formed from polyethylene terephthalate (PET) resin or polycarbonate (PC) resin by blowing.

Figure 2:
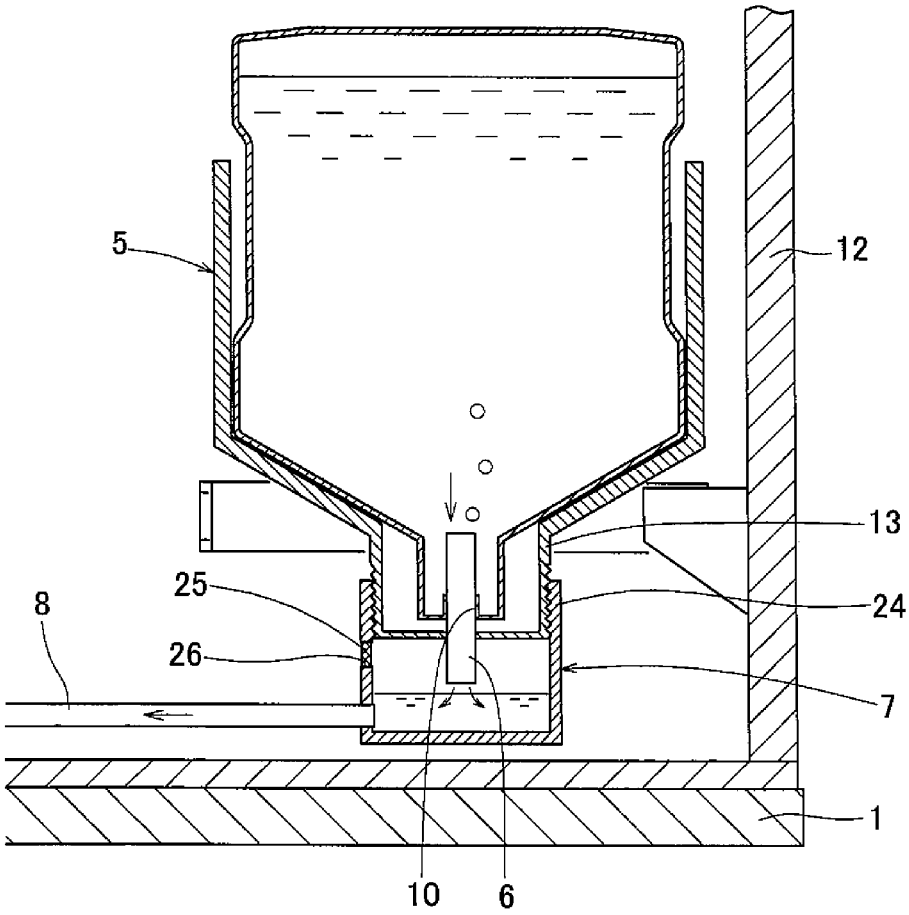
FIG. 2 shows how drinking water flows out of a raw water container of FIG. 1.
Figure 3:
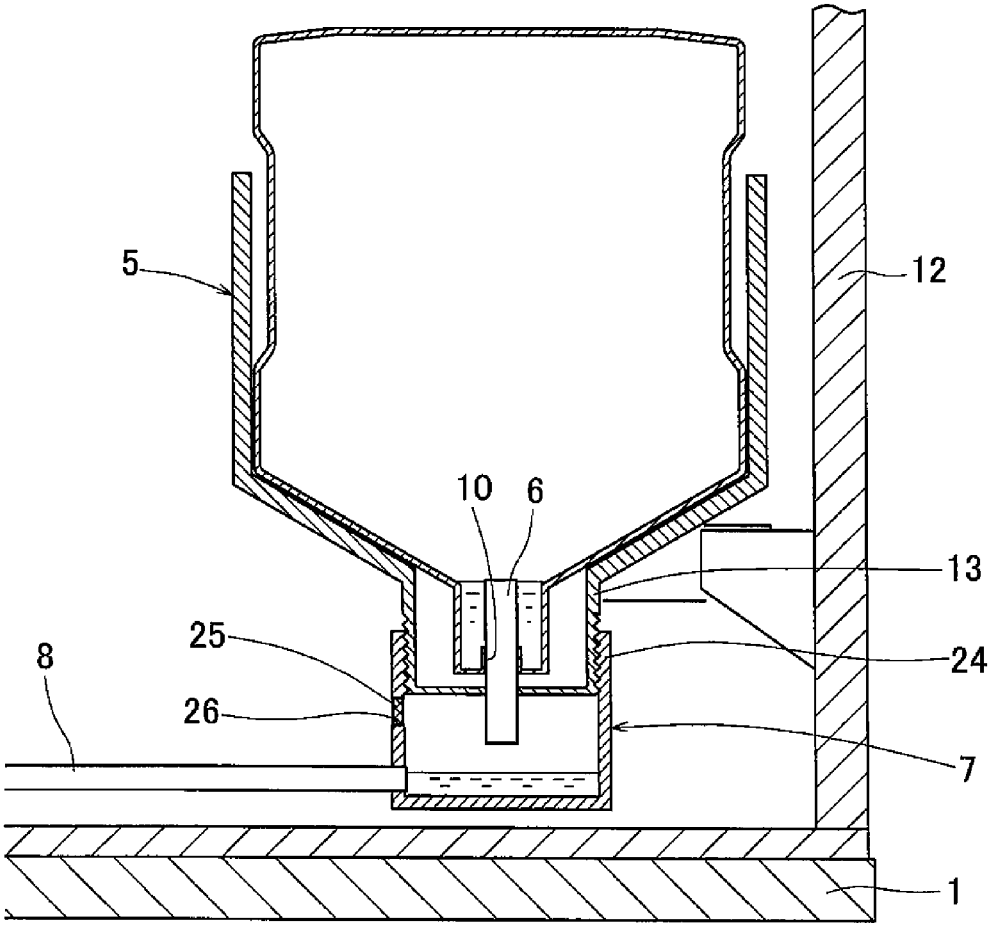
FIG. 3 shows a state in which drinking water in the raw water container of FIG. 1 has run out.

Referring to FIGS. 2 and 3, the container holder 5 has a cylindrical bottom portion 13 having a closed bottom end and formed with a thread on its outer periphery. The container holder 5 is configured such that when the raw water container 4 is placed in the container holder 5, the water outlet 10 of the raw water container 4 is located in the bottom portion 13 of the container holder 5.

The insertion pipe 6 extends vertically through the interior of the bottom portion 13 of the container holder 5 such that the top end portion of the insertion pipe 6 is inserted through the water outlet 10 of the raw water container 4 when the raw water container 4 is placed in the container holder 5. The insertion pipe 6 has a bottom end portion protruding downwardly from the bottom portion 13 of the container holder 5.

The water receiving container 7 is provided under the water outlet 10 of the raw water container 4. The water receiving container 7 is a cylindrical member with an open top and a closed bottom, and has a top end portion 24 formed with a thread groove in its inner periphery. The water receiving container 7 is further formed with a vent hole 26 which extends through the side wall thereof and in which a filter 25 is fitted. The vent hole 26 may be formed in the bottom of the bottom portion 13 of the container holder 5. The water receiving container 7 is detachably mounted to the bottom portion 13 of the container holder 5 by bringing the thread groove of the top end portion 24 of the water receiving container 7 into threaded engagement with the thread of the bottom portion 13 of the container holder 5.

While in this embodiment, the water receiving container 7 is mounted to the bottom portion 13 of the container holder 5 by threaded engagement between the thread groove and the thread, the top end portion 24 of the water receiving container 7 may be mounted to the bottom portion 13 of the container holder 5 by inserting driving screws into screw holes formed in the top end portion 24 of the water receiving container 7. Alternatively, the former may be mounted to the latter by engagement of engaging claws provided on one of the top end portion 24 of the water receiving container 7 and the bottom portion 13 of the container holder 5 in engaging holes formed in the other.

The insertion pipe 6 is arranged such that its bottom end is located in the water receiving container 7 with the water receiving container 7 mounted to the bottom portion 13 of the container holder 5. In this state, the vent hole 26 of the water receiving container 7 is located below the bottom portion 13 of the container holder 5 and above the bottom end of the insertion pipe 6. With the water receiving container 7 mounted to the bottom portion 13 of the container holder 5, the container holder 5 and the water receiving container 7 can be moved into and out of the casing 1 together with the slide table 12, by sliding the slide table 12.

When drinking water in the raw water container 4 flows through the insertion pipe 6 into the water receiving container 7, air in the water receiving container 7 flows into the raw water container 4. Air in the casing 1 (atmospheric air) is in turn introduced into the water receiving container 7 through the vent hole 26. On the other hand, when the water level in the water receiving container 7 rises, air in the water receiving container 7 is discharged through the vent hole 26. Thus, depending on whether the water level in the water receiving container 7 is rising or falling, air is discharged or introduced through the vent hole 26, keeping the interior of the water receiving container 7 at the atmospheric pressure. When air is introduced or discharged, the filter 25 in the vent hole 26 catches dust and dirt in the casing 1, preventing entry of dust and dirt into the water receiving container 7.

The capacity of the water receiving container 7 is such that 50 to 200 ml of drinking water is in the water receiving container 7 when the water level in the water receiving container 7 is at the bottom end of the insertion pipe 6. By setting the capacity of the portion of the water receiving container 7 below the bottom end of the insertion pipe 6 at 50 ml or over, it is possible to prevent air from being sucked into the pump 9 when drinking water in the water receiving container 7 is drawn up by the pump 9. By setting the capacity of this portion at 200 ml or less, it is possible to sufficiently shorten the time period necessary for normal temperature drinking water discharged from the raw water container 4 to be fed into the cold water tank 2, thereby preventing the occurrence of bacteria in drinking water.

The raw water supply line 8 is connected at one end thereof to the lower portion of the side wall of the water receiving container 7, and at the other end to the cold water tank 2. The water receiving container 7 is thus in communication with the cold water tank 2 through the raw water supply line 8. The pump 9 and a flow rate sensor 14 are mounted at an intermediate portion of the raw water supply line 8. The raw water supply line 8 is made of a flexible and shrinkable material to allow sliding movement of the slide table 12, which supports the container holder 5. In particular, the raw water supply line 8 may be made of urethane elastomer, vinyl chloride, fluororesin or silicon.

The pump 9 is a gear pump including a pair of gears that mesh with each other such that drinking water is fed by rotating the gears. The pump 9 is driven by an electric motor 29. When the pump 9 is activated, drinking water in the raw water supply line 8 is moved from the water receiving container 7 toward the cold water tank 2, whereby drinking water in the water receiving container 7 is fed into the cold water tank 2. The flow rate sensor 14 is capable of detecting the fact that drinking water has run out in the raw water supply line 8 while the pump 9 is activated.

A cooling device 15 is mounted to the cold water tank 2 and cools drinking water in the cold water tank 2. A baffle plate 16 is mounted in the cold water tank 2 and divides the interior of the cold water tank 2 into upper and lower spaces. The cooling device 15 is mounted on the outer periphery of the cold water tank 2 at its lower portion, and configured to keep drinking water below the baffle plate 16 at a low temperature (about 5° C.).

A water level sensor 17 is mounted in the cold water tank 2, and is configured to detect the level of drinking water in the cold water tank 2. When the level of drinking water in the cold water tank 2, as detected by the water level sensor 17, falls to a predetermined value, the pump 9 is activated to feed drinking water into the cold water tank 2 from the water receiving container 7.

The baffle plate 16 prevents low-temperature drinking water which has been cooled by the cooling device 15 and collected at the lower portion of the cold water tank 2 from being agitated by drinking water that has just been fed into the cold water tank 2 from the water receiving container 7.

A cold water discharge line 18 is connected to the cold water tank 2 such that low-temperature drinking water that has collected at the lower portion of the cold water tank 2 can be discharged to the outside through the cold water discharge line 18. The cold water discharge line 18 carries a cold water cock 19 which can be operated from outside the casing 1, whereby by opening the cold water cock 19, low-temperature drinking water in the cold water tank 2 can be discharged into e.g. a cup. The capacity of the cold water tank 2 is smaller than that of the raw water container 4, and is about 2 to 4 liters.

A tank connecting line 20 through which the cold water tank 2 is connected to the hot water tank 3 has its top end open at the central portion of the baffle plate 16. The hot water tank 3 includes a heating device 21 which heats drinking water in the hot water tank 3, thereby keeping drinking water in the hot water tank 3 at a high temperature (about 90° C.). The bottom end of the tank connecting line 20 is open in the hot water tank 3 at a position lower than the heating device 21.

A hot water discharge line 22 is connected to the hot water tank 3 such that high-temperature drinking water that has collected at the upper portion of the hot water tank 3 can be discharged to the outside through the hot water discharge line 22. The hot water discharge line 22 carries a hot water cock 23 which can be operated from outside the casing 1, whereby by opening the hot water cock 23, high-temperature drinking water in the hot water tank 3 can be discharged into e.g. a cup. When hot water is discharged from the hot water tank 3, the same amount of drinking water flows from the cold water tank 2 into the hot water tank 3 through the tank connecting line 20, so that the hot water tank 3 is always filled with drinking water. The capacity of the hot water tank 3 is about 1 to 2 liters.

Now referring to FIGS. 1 to 3, description is made of how the water dispenser embodying the present invention is used.

Until the water dispenser is set up at an intended use location (private home, office or hospital), the cold water tank 2, hot water tank 3 and water receiving container 7 are all kept empty. After being set up, a raw water container 4 filled with drinking water is connected to the water dispenser.

In particular, after sliding the slide table 12 out of the casing, the brand-new raw water container 4 is placed in the container holder 5 with the water outlet 10 facing down. With the raw water container 4 set in the container holder 5, the insertion pipe 6 is inserted through the water outlet 10 of the raw water container 4, so that drinking water in the raw water container 4 flows through the insertion pipe 6 into the water receiving container 7.

The raw water container 4 is rigid enough that the raw water container 4 is not collapsible when water remaining in the raw water container 4 decreases. Thus, when drinking water in the raw water container 4 flows out through the insertion pipe 6 into the water receiving container 7, the same amount of air in the water receiving container 7 as the water flowing into the water receiving container 7 flows through the insertion pipe 6 into the raw water container 4 (as shown in FIG. 2).

Drinking water flowing out of the raw water container 4 is stored in the water receiving container 7, so that the water level in the water receiving container 7 rises. When the water level in the container 7 reaches the bottom end of the insertion pipe (as shown in FIG. 1), air stops flowing into the raw water container 4 through the insertion pipe 6, which stops the flow of drinking water from the raw water container 4. In this state, the internal pressure of the raw water container 4 is equal to the atmospheric pressure.

When the pump 9 is activated in this state, drinking water in the water receiving container 7 is fed into the cold water tank 2 through the raw water supply line 8. When the water level sensor 17 detects that the water level in the cold water tank 2 has exceeded a predetermined upper limit while the pump 9 is activated, the pump 9 is deactivated.

When a user opens the cold water cock 19 or a hot water cock 23 to discharge drinking water into e.g. a cup, and as a result, the water level sensor 17 detects that the water level in the cold water tank 2 has fallen below a predetermined lower limit, the pump 9 is activated to feed drinking water in the water receiving container 7 into the cold water tank 2 through the raw water supply line 8.

When drinking water in the water receiving container 7 is fed into the cold water tank 2, and as a result, the water level in the water receiving container 7 has fallen below the bottom end of the insertion pipe 6, air flows into the raw water container 4 through the insertion pipe 6, and simultaneously, drinking water in the raw water container 4 flows out through the insertion pipe 6 into the water receiving container 7.

When the flow rate sensor 14 detects that drinking water in the raw water supply line 8 runs out while the pump 9 is activated, it is considered that drinking water has run out both in the water receiving container 7 and the raw water container 4 as shown in FIG. 3. In this state, a container replacement lamp 28 is turned on.

When the container replacement lamp 28 is turned on, an operator pulls the slide table 12 out of the casing, and replaces the empty raw water container 4 with a new raw water container 4 filled with drinking water.

Thus, by using this water dispenser, when drinking water in the raw water container 4 flows out into the water receiving container 7, which is disposed under the raw water container 4, the same amount of air in the water receiving container 7 as the water flowing into the water receiving container 7 flows into the raw water container 4 through the insertion pipe 6 (thus replacing water that has flowed out of the raw water container 4). This prevents negative pressure from being created in the raw water container 4, which in turn makes it possible to use up drinking water in the raw water container 4, and to more smoothly draw up drinking water in the water receiving container 7 by means of the pump 9.

Since drinking water in the raw water container 4 flows out into the water receiving container 7 until the raw water container 4 becomes completely empty, it is possible to smoothly draw up drinking water in the water receiving container 7 with the pump 9.

What is claimed is:

1. A water dispenser comprising:

a cold water tank in which drinking water can be cooled, a container holder located at a level lower than the cold water tank and configured such that a replaceable raw water container can be placed in the container holder with a water outlet of the raw water container facing downward, an insertion pipe mounted to the container holder and configured to be inserted through the water outlet when the raw water container is placed in the container holder, a water receiving container having a side wall and being configured to receive drinking water flowing from the raw water container through the water outlet and the insertion pipe, and a raw water supply line through which drinking water in the water receiving container can be drawn up into the cold water tank by a pump, wherein a vent hole, through which air can be introduced into and discharged from the water receiving container, is formed through the side wall of the water receiving container, wherein the insertion pipe has a bottom end portion protruding downwardly from a bottom portion of the container holder, the bottom end portion of the insertion pipe having a bottom end disposed in the water receiving container, and wherein the vent hole is located at a level below the bottom portion of the container holder and above a bottom end of the bottom end portion of the insertion pipe.

* * * * *